US009812103B2

(12) United States Patent
Kulcsar

(10) Patent No.: US 9,812,103 B2
(45) Date of Patent: Nov. 7, 2017

(54) DRUMSTICK GRIPPING DEVICE

(71) Applicant: Donnie D. Kulcsar, Port St. Lucie, FL (US)

(72) Inventor: Donnie D. Kulcsar, Port St. Lucie, FL (US)

(73) Assignee: GLORIOUS DESTINY, LLC, Port St. Lucie, FL (US)

( * ) Notice: Subject to any disclaimer, the term of this patent is extended or adjusted under 35 U.S.C. 154(b) by 0 days.

(21) Appl. No.: 15/242,660

(22) Filed: Aug. 22, 2016

(65) Prior Publication Data

US 2017/0221462 A1 Aug. 3, 2017

Related U.S. Application Data

(60) Provisional application No. 62/290,212, filed on Feb. 2, 2016.

(51) Int. Cl.
*G10G 5/00* (2006.01)
*G10D 13/00* (2006.01)

(52) U.S. Cl.
CPC ..... *G10G 5/005* (2013.01); *G10D 13/003* (2013.01)

(58) Field of Classification Search
CPC ..... G10D 13/003
USPC ..... 84/422.4
See application file for complete search history.

(56) References Cited

U.S. PATENT DOCUMENTS 7,435,889 B1 * 10/2008 Heidt ..... G10D 13/003 84/320
2009/0044684 A1 * 2/2009 Avartanian ..... G10D 13/003 84/422.4

OTHER PUBLICATIONS

Amazon.com: Drummers leash—twirling stick grip: musical instruments (https://www.amazon.com/Drummers-leash-twirling-stick-grip) accessed on Aug. 2, 2016.
Amazon.com: Groove sticks—twirl your drumsticks!: musical instruments (https://www.amazon.com/groove-sticks-twirl-your-drumsticks) accessed on Aug. 2, 2016.

* cited by examiner

*Primary Examiner* — Kimberly Lockett
(74) *Attorney, Agent, or Firm* — Fox Rothschild LLP

(57) ABSTRACT

A drumstick gripping device is provided for a drumstick comprising tip, shoulder and grip portions. The drumstick gripping device includes a collar defining a collar opening for the insertion and engagement of a drumstick. The diameter of the collar opening is larger than the diameter of the drumstick tip and shoulder portions and smaller than the diameter of at least a portion of a drumstick grip portion. The collar can be engaged to a portion of the drumstick grip portion. A looped finger grip defines a finger grip opening for the insertion of a finger. The finger grip is connected to the collar wherein the finger grip opening is offset from and transverse to the collar opening. A drumstick system and a method of drumming are also disclosed.

10 Claims, 5 Drawing Sheets

DRUMSTICK GRIPPING DEVICE

CROSS-REFERENCE TO RELATED APPLICATION

This Application claims priority to U.S. Provisional Application No. 62/290,212 filed Feb. 2, 2016, entitled Stick-Twirl, the entirety of which is incorporated herein by reference.

FIELD OF THE INVENTION

The present invention relates to musical instruments, and more particularly to drums and accessories for drums.

BACKGROUND OF THE INVENTION

Playing the drums in live performances involves technical skill and preferably some degree of showmanship. It is not uncommon for drummers to prominently display and spin the drumsticks during a performance. Spinning the drumsticks requires a dexterity and skill level that is not possessed by all drummers. Various accessories have been created to assist the drummer in spinning the drumsticks, but these accessories do not afford ease of installation and use, without modification to the drumsticks.

SUMMARY OF THE INVENTION

A drumstick gripping device is provided for a drumstick comprising tip, shoulder and grip portions. The drumstick gripping device includes a collar defining a collar opening for the insertion and engagement of a drumstick. The diameter of the collar opening is larger than the diameter of the drumstick tip and shoulder portions and smaller than the diameter of at least a portion of a drumstick grip portion. The collar can be slid over the tip and shoulder portions of the drumstick and will engage a portion of the drumstick grip portion. A looped finger grip defines a finger grip opening for the insertion of a finger. The finger grip is connected to the collar wherein the finger grip opening is offset from and transverse to the collar opening.

The collar can be tubular. The collar can include a peripheral slot for expansion of the collar. The collar can be both tubular and include a longitudinal slot. The collar can be elastic. The collar opening can be from 0.25" to 2" in diameter.

The finger grip can be radially perpendicular to and longitudinally aligned with the collar. The finger grip opening can be sized to receive no more than a single finger, such as the index finger. The finger grip opening can be from 0.25 to 3" in diameter.

A drumstick system includes a drumstick having tip, shoulder and grip portions. A drumstick gripping device includes a collar and a looped finger grip. The collar defines a collar opening for the insertion and engagement of the drumstick. The diameter of the collar opening can be larger than the diameter of the drumstick tip and shoulder portions and smaller than the diameter of at least a portion of the drumstick grip portion. The looped finger grip defines a finger grip opening for insertion of a finger. The finger grip can be connected to the collar wherein the finger grip opening is offset from and transverse to the collar opening. The collar can be slid over the tip and shoulder portions of the drumstick or otherwise engaged to a portion of the grip portion. The looped finger grip can extend radially outward from and can be longitudinally aligned with the drumstick.

A method of drumming includes the step of providing a drumstick comprising tip, shoulder and grip portions. A drumstick gripping device is provided. The drumstick gripping device can include a collar and a looped finger grip. The collar defines a collar opening for the insertion and engagement of the drumstick. The diameter of the collar opening can be larger than the drumstick tip and shoulder portions and smaller than at least a portion of a drumstick grip portion. The looped finger grip defines a finger grip opening for insertion of a finger. The finger grip can be connected to the collar wherein the finger grip opening is offset from and transverse to the collar opening.

The collar can be slid over the tip and shoulder portions of the drumstick or otherwise positioned such that it engages a portion of the grip portion of the drumstick. The drumstick is grasped at the grip portion with at least the index finger extending through the finger grip opening of the looped finger grip. Drumming with the drumstick can then take place, and intermittently the collar and drumstick can be rotated about the index finger.

BRIEF DESCRIPTION OF THE DRAWINGS

There are shown in the drawings embodiments that are presently preferred it being understood that the invention is not limited to the arrangements and instrumentalities shown, wherein.

DETAILED DESCRIPTION OF THE INVENTION

Figure 1:
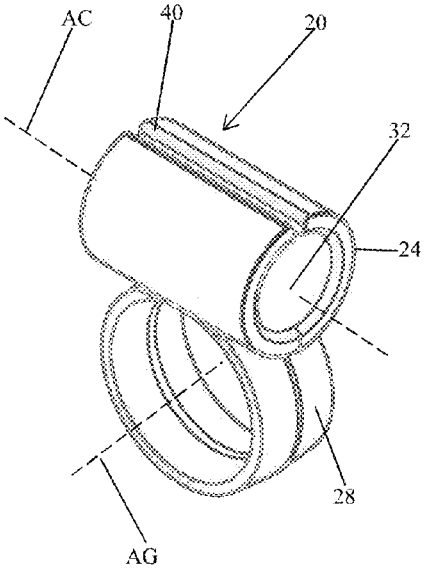
FIG. 1 is a top front perspective view of a drumstick gripping device according to the invention.
Figure 2:
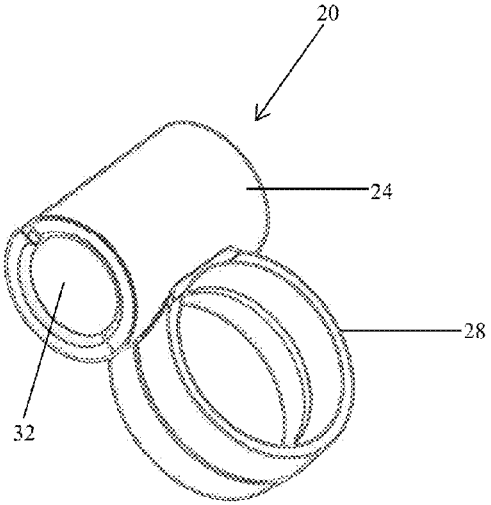
FIG. 2 is a bottom rear perspective view.
Figure 3:
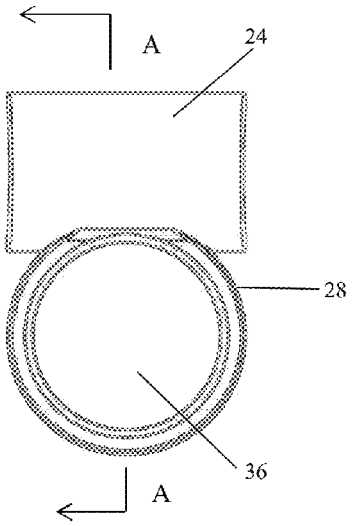
FIG. 3 is a right side elevation.
Figure 4:
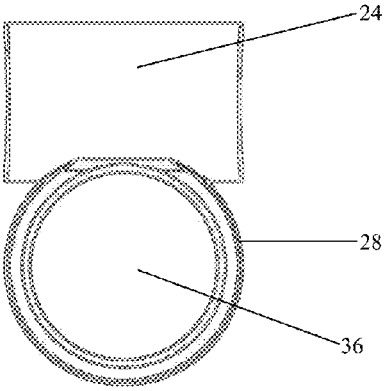
FIG. 4 is a left side elevation.
Figure 5:
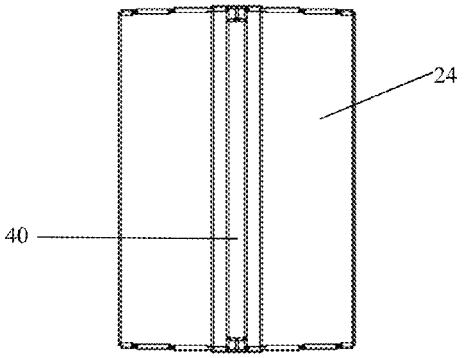
FIG. 5 is a plan view.

There is shown in the drawings a drumstick gripping device 20 that is provided for a drumstick 50 comprising tip 54, shoulder 58 and grip 62 portions. The drumstick gripping device 20 includes a collar 24 and a finger grip 28. The collar 24 defines a collar opening 32 for the insertion and engagement of a drumstick. The diameter of the collar opening 32 is larger than the diameter of the drumstick tip 54 and shoulder 58 portions and smaller than the diameter of at least a portion of a drumstick hand grip 62 portion. The collar 24 can be slid over the tip 54 and shoulder 58 portions of the drumstick and will engage a portion of the drumstick grip 62 portion of the drumstick 50. The looped finger grip 28 defines a finger grip opening 36 for the insertion of a finger.

The finger grip 28 is connected to the collar 24 wherein the finger grip opening is offset from and transverse to the collar opening. As shown in FIG. 1, the axis AC of the collar opening 32 and the axis AG of the ring opening 36 are offset and transverse. In FIG. 1 the axis AG is substantially perpendicular to the axis AC, although a deviation from perpendicular of less than 5° or less than 10° is possible. Similarly the finger grip 28 is substantially aligned with the length of the collar 24 (FIG. 6) although deviation of less than 5° or less than 10° is possible.

The collar 24 can be elongated and tubular, or can be truncated and substantially a ring. A tubular design for the collar 24 assists in gripping the drumstick 50. The collar 24 can include a peripheral slot 40 to facilitate some expansion of the collar 24. The collar 24 can be both tubular and include the longitudinal slot 40.

The collar 24 can be elastic so as to engage the drumstick 50 with a compression and/or frictional fit. The collar 24 can be made of plastic or metal, or some combination of plastic or metal. The collar opening 32 is sized so as to engage at least a portion of the hand grip 62 of the drumstick 50. The dimension of drumsticks varies, however the diameter of the hand grip 62 is most commonly in a range from about 0.25" to about 1". The collar opening 32 should be dimensioned to be somewhat smaller, for example from 1% to 5%, 10%, 15%, 20%, or 25% smaller than the diameter of the grip 62 that will be engaged, or between a range of any high or low value from 1 to 25%. The elasticity of the collar 24 is selected so as to permit the collar 24 to flex to be positioned over the hand grip 62, and then retract to flexibly engage the hand grip 62. The slot 40 will assist in flexing of the collar 24 and positioning of the collar 24 on the hand grip 62. The collar 24 will thereby elastically and frictionally engage the hand grip 62. The collar opening 32 can preferably be from 0.25 to 2" in diameter, or within a range of any high and low value within this range.

Figure 6:
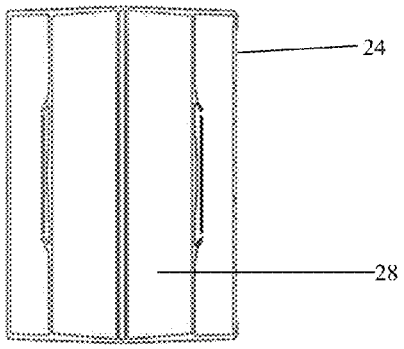
FIG. 6 is a bottom view.
Figure 7:
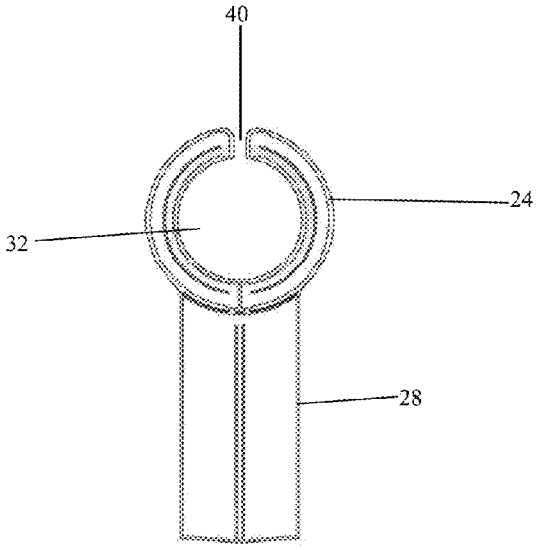
FIG. 7 is a front elevation.
Figure 9:
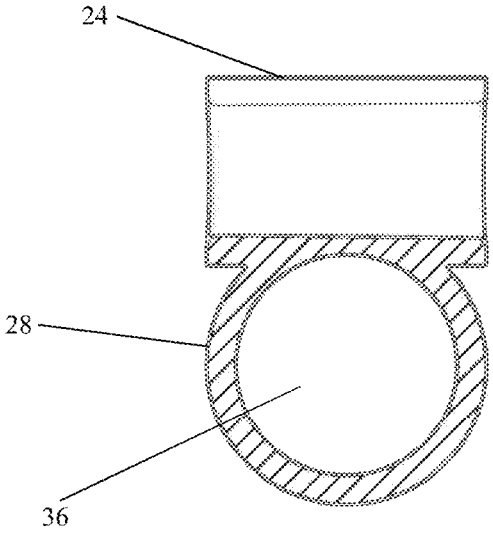
FIG. 9 is a cross-section taken along line B-B in FIG. 8.
Figure 8:
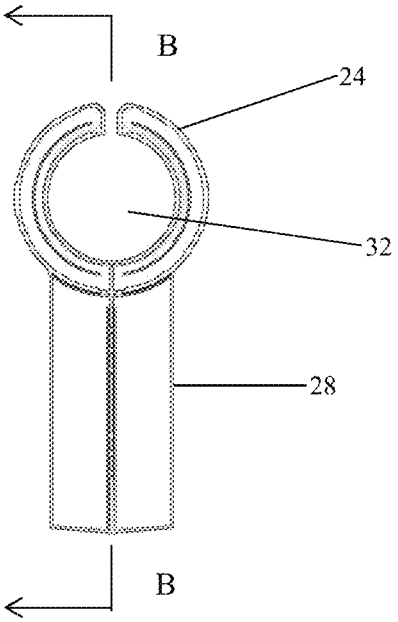
FIG. 8 is a rear elevation.
Figure 10:
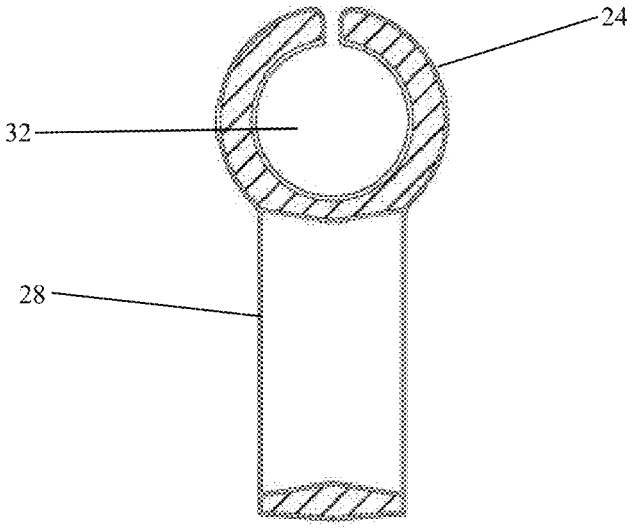
FIG. 10 is a cross-section taken along line A-A in FIG. 3.

The finger grip 28 should preferably be no wider than the width of the collar 24, and as shown in FIG. 6 it can be narrower. The finger grip opening 36 can be any suitable size. In one embodiment, the finger grip opening is sized to receive no more than a single finger, such as the index finger. The size of the finger grip opening 36 can preferably be from 0.25 to 3" in diameter, or within a range of any high or low value within this range.

Figure 11:
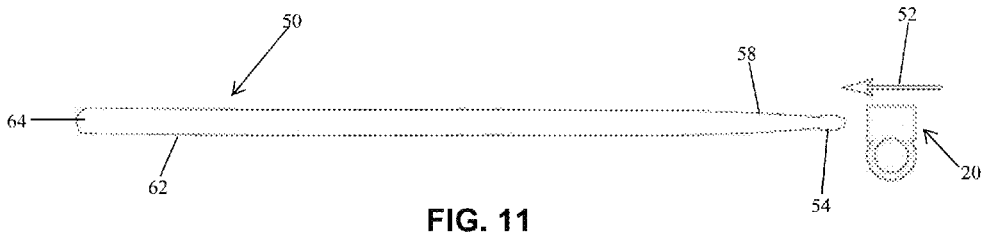
FIG. 11 is a side elevation illustrating a drumstick system assembly according to the invention.
Figure 12:
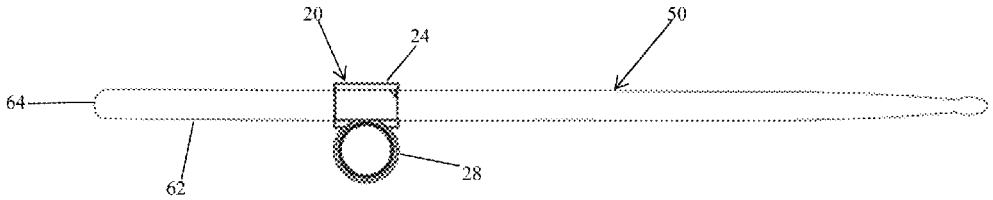
FIG. 12 is a side elevation, partially in phantom, of a drumstick system according to the invention.

The assembly of a drumstick system is shown in FIGS. 11-12. The drumstick gripping device 20 is moved in the direction of arrow 52 over the tip 54 and shoulder 58 of drumstick 50. The drumstick gripping device 20 is moved distally toward the end 64 of the drumstick 50 until it engages a portion of the hand grip 62. A slight force can be applied to the gripping device 20 so as to expand the collar 24 to permit the collar 24 to flexibly engage a portion of the grip 62 that is somewhat larger than the unexpanded size of the collar opening 32. It is alternatively possible to position the drumstick gripping device 20 from the end 64 of the drumstick 50 or to snap-fit from a sideways direction directly onto the hand grip 62.

The assembled drumstick system includes the drumstick 50 and drumstick gripping device 20 as shown in FIG. 12. The drumstick gripping device 20 is positioned several inches from the end 64 to permit the user to grip the hand grip 62 of the drumstick 50.

Figure 13:
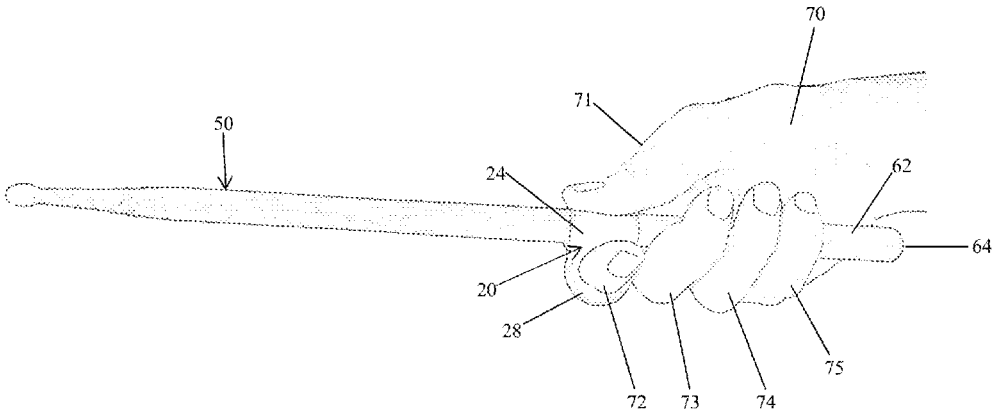
FIG. 13 is a side elevation of a method of drumming, in a $1^{st}$ mode of operation.
Figure 14:
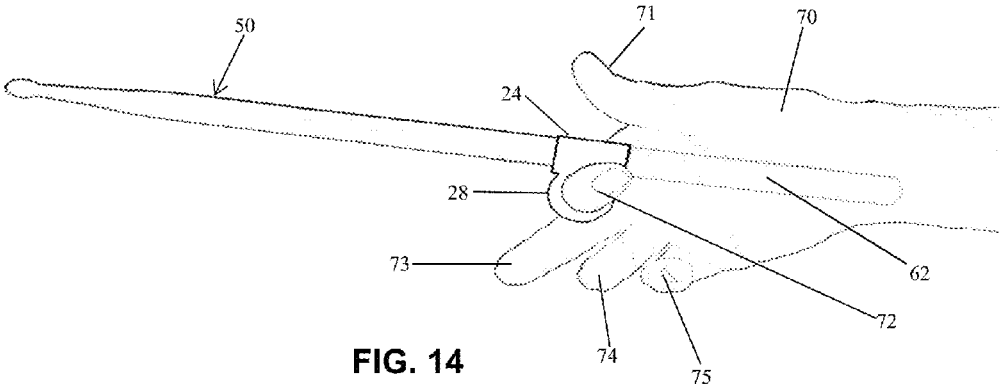
FIG. 14 is a side elevation in a $2^{nd}$ mode of operation.
Figure 15:
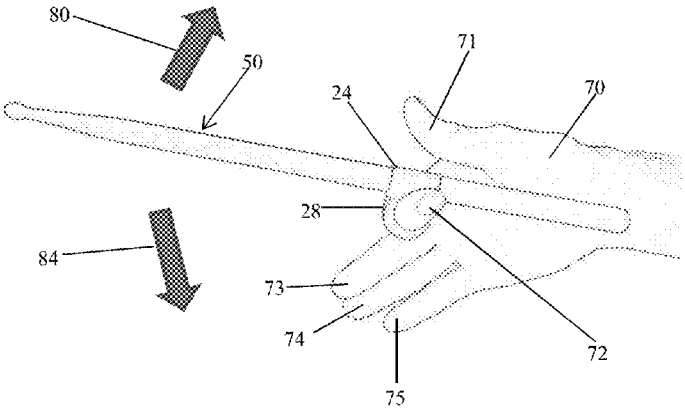
FIG. 15 is a side elevation in a $3^{rd}$ mode of operation.

A method of drumming is shown in FIGS. 13-15. The user positions the hand 70 on the drumstick 50 as shown in FIG. 13. The finger grip 28 can be pointed downward and the thumb 71 rests on top of the drumstick 50 and can rest on the collar 24. The index finger 72 is positioned through the opening 36 of the finger grip 28. The middle finger 73, ring finger 74, and little finger 75 can be wrapped about the hand grip 62. The drumstick 50 can be used to drum in the customary fashion.

The drummer begins the spin by releasing the middle finger 73, ring finger 74 and little finger 75 from the hand grip 62 (FIG. 14). The thumb 71 is also removed from contact with the drumstick 50 and/or the collar 24. The middle finger 73, ring finger 74 and little finger 75 are fully extended so as to not interfere with rotation of the drumstick 50 (FIG. 15). The drumstick 50 can then be rotated either clockwise (arrow 80) or counterclockwise (arrow 84) depending on the desire of the drummer. The drumstick 50 can then be grasped again about the hand grip 62 and the drummer can return to normal play until spinning is again desired.

This invention can be embodied in other forms without departing from the spirit or essential attributes thereof and accordingly reference should be made to the following claims to determine the scope of the invention.

I claim:

1. A drumstick gripping device for a drumstick comprising tip, shoulder and grip portions, the drumstick gripping device comprising:

a collar defining a collar opening for the insertion and engagement of a drumstick, the diameter of the collar opening being larger than the diameter of the drumstick tip and shoulder portions and smaller than the diameter of at least a portion of a drumstick grip portion, wherein the collar will engage a portion of the drumstick hand grip portion;

a rigid looped finger grip defining a finger grip opening for insertion of a finger, the finger grip opening being dimensioned to receive no more than one finger and at least the index finger while permitting rotation of the finger grip about the index finger and thereby twirling of the drumstick and removal of the drumstick grip device and the drumstick from the index finger;

the finger grip being rigidly fixed to the collar wherein the finger grip opening is offset from and perpendicular to the collar opening.

2. The drumstick gripping device of claim 1, wherein the collar is tubular.

3. The drumstick gripping device of claim 1, wherein the collar comprises a peripheral slot for expansion of the collar.

4. The drumstick gripping device of claim 1, wherein the collar is tubular and comprises a longitudinal slot.

5. The drumstick gripping device of claim 1, wherein the collar is elastic to flexibly engage the hand grip portion of the drumstick.

6. The drumstick gripping device of claim 1, wherein the collar opening is from 0.25" to 2" in diameter.

7. The drumstick gripping device of claim 1, wherein the finger grip opening is from 0.25 to 3" in diameter.

8. The drumstick gripping device of claim 1, wherein the finger grip is radially perpendicular to and longitudinally aligned with the collar.

9. A drumstick system, comprising:

a drumstick comprising tip, shoulder and grip portions;

a drumstick gripping device, comprising a collar and a rigid looped finger grip, the collar defining a collar opening for the insertion and engagement of the drumstick, the diameter of the collar opening being larger than the diameter of the drumstick tip and shoulder portions and smaller than the diameter of at least a portion of the drumstick grip portion, the looped finger grip defining a finger grip opening for insertion of a finger, the finger grip opening being dimensioned to receive no more than one finger and at least the index finger while permitting rotation of the finger grip about the index finger and thereby twirling of the drumstick and drumstick gripping device about the index finger, and removal of the drumstick gripping device and the drumstick from the index finger, the finger grip being rigidly fixed to the collar wherein the finger grip opening is offset from and perpendicular to the collar opening, the collar engaging a portion of the grip portion, the looped finger grip extending radially outward from and longitudinally aligned with the drumstick.

10. A method of drumming, comprising the steps of:

providing a drumstick comprising tip, shoulder and grip portions;

providing a drumstick gripping device, the drumstick gripping device comprising a collar and a rigid looped finger grip, the collar defining a collar opening for the insertion and engagement of the drumstick, the diameter of the collar opening being larger than the drumstick tip and shoulder portions and smaller than at least a portion of a drumstick grip portion, and the looped finger grip defining a finger grip opening for insertion of a finger, the finger grip opening being dimensioned to receive no more than one finger and at least the index finger while permitting rotation of the finger grip about the index finger and thereby twirling of the drumstick and drumstick gripping device about the index finger, and removal of the drumstick gripping device and the drumstick from the index finger, the finger grip being rigidly fixed to the collar wherein the finger grip opening is offset from and perpendicular to the collar opening;

engaging the collar to a portion of the grip portion of the drumstick;

grasping the drumstick at the grip portion with at least the index finger extending through the finger grip opening of the looped finger grip; and, drumming with the drumstick and intermittently rotating the collar and drumstick about the index finger.

* * * * *